US009567130B1

(12) United States Patent
Drouet et al.

(10) Patent No.: US 9,567,130 B1
(45) Date of Patent: Feb. 14, 2017

(54) CARTON AND BLANK FOR CARTON

(71) Applicant: Metsä Board Oyj, Metsä (FI)

(72) Inventors: Cyril Drouet, Ääekoski (FI); Alan Li, Äänekoski (FI)

(73) Assignee: Metsä Board Oyj, Äänekoski (FI)

( * ) Notice: Subject to any disclaimer, the term of this patent is extended or adjusted under 35 U.S.C. 154(b) by 0 days.

(21) Appl. No.: 15/187,810

(22) Filed: Jun. 21, 2016

(30) Foreign Application Priority Data

May 2, 2016 (EP) ..... 16167886

(51) Int. Cl.

| | |
|---|---|
| ***B65D 5/52*** | (2006.01) |
| ***B65D 5/40*** | (2006.01) |
| ***B65D 5/74*** | (2006.01) |
| ***B65D 5/02*** | (2006.01) |
| ***B65D 5/10*** | (2006.01) |
| ***B65D 5/468*** | (2006.01) |
| ***B65D 5/42*** | (2006.01) |

(52) U.S. Cl.
CPC ..... *B65D 5/52* (2013.01); *B65D 5/0227* (2013.01); *B65D 5/106* (2013.01); *B65D 5/40* (2013.01); *B65D 5/4266* (2013.01); *B65D 5/4608* (2013.01); *B65D 5/5206* (2013.01); *B65D 5/746* (2013.01)

(58) Field of Classification Search
CPC ..... B65D 5/5206
USPC ..... 229/104
See application file for complete search history.

(56) References Cited

U.S. PATENT DOCUMENTS

| | | | | |
|---|---|---|---|---|
| 1,993,383 A * | 3/1935 | Rossi | B65D 5/5206 | 206/45.26 |
| 3,021,042 A * | 2/1962 | Stumpf, Jr. | B65D 5/5206 | 206/805 |
| 3,370,774 A * | 2/1968 | Hopf | B65D 77/065 | 222/156 |
| 3,519,190 A * | 7/1970 | Achermann | B65D 19/20 | 108/51.3 |
| 4,320,839 A * | 3/1982 | Skaggs | B65D 5/5069 | 206/591 |

(Continued)

FOREIGN PATENT DOCUMENTS

| | | |
|---|---|---|
| CH | 655702 A5 | 5/1986 |
| CH | 518560 | 6/2001 |

(Continued)

*Primary Examiner* — Gary Elkins
(74) *Attorney, Agent, or Firm* — Seppo Laine Oy

(57) ABSTRACT

The present invention provides a carton for a bag in box packaging. The carton has the overall configuration of a rectangular parallelepiped, with two pairs of opposing sidewalls and an upper end portion and a lower end portion, together defining a cavity for receiving a liquid holding bag. In the lower end portion there are a first pair of opposing flaps and a second pair of opposing flaps. The carton further has an opening extending through one sidewall in the lower end portion for dispensing liquid from a bag positioned inside the cavity. According to the invention the first pair of opposing flaps are foldable into an open position, in which the flaps extend outwards from the cavity to form a pair of legs. The legs are interlockable with a flap of said second pair of flaps so as firmly to fix the position of the legs with regard to the carton. The leg-forming flaps support the carton in an elevated position with respect to a surface thus facilitating dispension of liquid through the opening.

20 Claims, 2 Drawing Sheets

(56) References Cited

U.S. PATENT DOCUMENTS

| | | | | | |
|---|---|---|---|---|---|
| 4,938,343 | A * | 7/1990 | Willis | B65D 5/5206 206/45.22 |
| 5,909,841 | A * | 6/1999 | Andrews, Sr. | B65D 77/065 229/104 |
| 8,857,701 | B2 * | 10/2014 | Mandreucci | B23P 17/00 206/45.21 |
| 2004/0051008 | A1 | 3/2004 | Tominello et al. | |
| 2006/0163333 | A1 * | 7/2006 | Kornacki | B65D 5/001 229/104 |
| 2011/0095037 | A1 | 4/2011 | Fälkenström | |

FOREIGN PATENT DOCUMENTS

| | | | | |
|---|---|---|---|---|
| EP | 1826130 | | 8/2007 | |
| FR | 2798912 | | 9/2001 | |
| FR | 2856039 | | 12/2004 | |
| GB | 617575 | * | 2/1949 | B65D 5/5206 |
| GB | 1312374 | * | 4/1973 | B65D 5/5206 |
| GB | 2417482 | | 3/2006 | |
| NL | 8900666 | | 10/1990 | |
| WO | WO 2007118992 | | 10/2000 | |
| WO | WO 2005019063 | | 3/2005 | |

* cited by examiner

CARTON AND BLANK FOR CARTON

FIELD

The present invention relates to cartons, and more particularly to cartons for bag-in-box type packagings for liquids.

BACKGROUND

Bag-in-box packagings are widely used for storing various beverages, such as wine or juice. The packaging is formed of a flexible pouch or bag containing the liquid, and a rigid carton box enclosing the pouch. The pouch is equipped with a tap for dispensing the liquid to a receptacle, such as a glass. The carton contains an opening for accommodating the tap in a serving position.

A known disadvantage of the bag-in-box packagings is that the tap is located in a lower part of the packaging, which makes it difficult to position a glass underneath the tap. Either the glass must be held in an extremely tilted position, or the packaging must be positioned near the edge of a table or a corresponding surface. A further alternative is to place a separate holder or a stand, such as a plastic base, under the packaging to raise it.

Different solutions have been proposed in the prior art in order to solve these problems.

US 2011095037 (A1) discloses a stand that is based on two nested carton boxes. The user presses in tabs forming supporting sections, whereby four support points for a liquid container are formed.

EP 1826130 (B1) discloses a raising device for a wine package. It contains four lateral walls including lower parts, where each wall is perpendicular to two contiguous lateral walls. Each lower part of the wall is subjected to fold back towards an interior of the device, such that one of the folded lower parts serves as a support to a wine package.

FR 2798912 (A1) describes a stand that is based on flaps extending outwards from the bottom of the carton box.

NL 8900666 (A) describes a wine package that is slidable within an outer container. The package can be fixed at a certain height by pushing in triangular perforated areas that are located in the vertical ribs that join the sidewalls of the outer container.

Solutions that are based on the use of a separate stand are cumbersome, because the stand might not be available at all times and it must be purchased separately. Transporting and storing separate stands, or combinations of a stand and a liquid packaging, is not cost-effective.

Solutions that are based on two nested carton boxes, slidable vertically with respect to each other, require that the inner carton box and the outer carton box cooperate, which poses limitations to the design of the actual bag-in-box system and the tap construction.

Most of the known solutions provide a raised carton box in which a rather bulky stand in its assembled position occupies essentially the entire table surface that is located under the carton box. Positioning and centering a glass under the tap is therefore more difficult with such a stand in use when compared to placing the carton box on the edge of a table and holding a glass below the tap and partly under the table.

SUMMARY OF THE INVENTION

There is a need to provide an integrated stand for a bag-in-box container that is more independent of the main body of the packaging, particularly of its form, material, functions and design.

There is a further need for developing an integrated stand that does not pose limitations to the design, dimensions and usability of the tap.

Surprisingly, we have observed that this problem can be solved by the present invention by utilizing a new bottom flap construction in the carton surrounding the liquid pouch in a bag-in-box packaging.

Thus, in the lower end portion of the carton there are a first pair of opposing flaps and a second pair of opposing flaps. The carton further has an opening extending through one sidewall in the lower end portion for dispensing liquid from a bag positioned inside the cavity. According to the invention the first pair of opposing flaps are foldable into an open position, in which the flaps extend outwards from the cavity to form a pair of legs. The legs are further interlockable with a flap of the second pair of flaps so as firmly to fix the position of the legs with regard to the carton and to confer properties of lateral rigidity to the flaps. The leg-forming flaps support the carton in an elevated position with respect to a surface thus facilitating dispension of liquid through the opening.

More specifically, the invention is defined by the features of the independent claims. A number of specific embodiments are defined in the dependent claims.

The present invention provides considerable advantages. There is no need to obtain a separate holder or stand as it is now integrated to the carton itself. The stand and the carton are made of the same or essentially the same material, preferably corrugated cardboard. The stand can thus be recycled together with the carton itself.

A further advantage of the present invention is that the stand can be formed without adding extra material or cardboard layers to the packaging, as the stand utilizes only the flaps of the carton.

A major advantage is that using, assembling, and dismounting the stand can be carried out irrespective of the position of the tap. Assembling the stand does not require pulling out of the tap to a dispensing position. The stand can be easily dismounted without any need for pushing the tap back inside the carton. Essentially, the area surrounding the hole for the tap remains intact.

A further advantage of the present invention is that the stand allows room for positioning a glass or receptacle right under the tap, as the stand does not occupy the entire table surface area under the packaging.

EMBODIMENTS

Definitions

Figure 1:
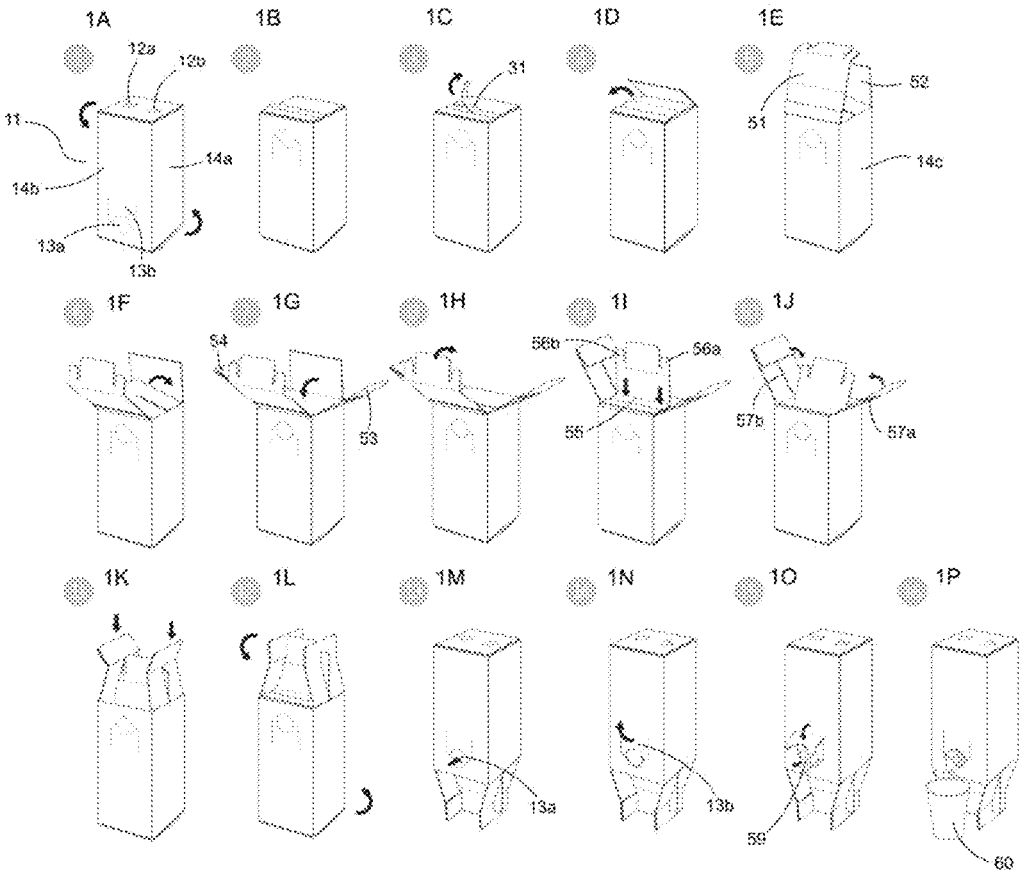
FIGS. 1A to 1P (also 1 to 16 in FIG. 1) illustrate how a carton in accordance with at least some embodiments of the present invention is assembled to a serving position.

In the present context, "a carton" means a paperboard box with an overall configuration of a rectangular parallelepiped, which box is closed or able to be closed by flaps at its upper and lower end portions.

In the present context, "a bag in box packaging" means a carton enclosing a flexible bag containing a fluid, such as liquid, and equipped with a tap or a valve.

In the present context, "a blank" means an unfolded pre-cut carton in an essentially two-dimensional form.

The invention provides a carton for a bag in box packaging. The present invention provides a new solution for elevating the carton with regard to a surface, such as a table surface, in order to facilitate dispensing of liquid from a liquid holding bag inside the carton.

In one embodiment, the carton is for a bag-in-box type packaging, in which the carton functions as an outer rigid container enclosing an inner flexible plastic container (not shown in the drawings) containing liquid and provided with a tap for dispensing the liquid.

In this embodiment, the outer container contains an opening extending through one sidewall in the vicinity of the lower end portion of the carton, through which opening liquid can be dispensed from the inner container.

The lower end is closed by pairs of opposite flaps, one pair of which form legs for elevating the container on a support, and at least one flap of the second pair of flaps interlock the legs so as to provide lateral rigidity to the container raised upon the leg-forming flaps.

In one embodiment, the carton comprises a board which has a stiffness sufficient for supporting and containing the liquid-holding bag. Naturally, the flaps need to be of a material having sufficient stiffness for allowing them to form legs which are capable of withstanding the weight of liquid filled bag-in-box without collapsing. Preferably, the carton is made of a blank formed by board having properties of stiffness. Examples of such boards are corrugated boards and folding boxboards.

According to one embodiment, there is provided a carton for a bag in box packaging having the overall configuration of a rectangular parallelepiped, with two pairs of opposing sidewalls and an upper end portion and a lower end portion, together defining a cavity for receiving a liquid holding bag. The lower end portion comprises a first pair of opposing flaps and a second pair of opposing flaps. The carton further has an opening extending through one sidewall in the vicinity of the lower end portion, through which opening liquid can be dispensed from the liquid holding bag positioned inside the cavity.

Preferably, the first pair of opposing flaps are foldable into a closed position, in which the flaps together with the second pair of opposing flaps close the lower end portion, and an open position, in which the flaps extend outwards from the cavity to form a pair of legs, while a first flap of said second pair of opposing flaps is foldable into an open position where it is capable of interlocking said first pair of opposing flaps when they are folded into the open position, in order to fix the position of the legs with regard to the carton. The leg-forming flaps are capable of supporting the carton on a surface so as to provide an elevated position for the opening with respect to the surface.

According to a second aspect of the present invention, there is provided a bag-in-box packaging comprising a carton according to the present invention, wherein the cavity of the carton encloses a liquid holding bag equipped with a tap arranged to extend through the opening extending through one sidewall in the vicinity of the lower end portion.

According to a third aspect of the present invention, there is provided a blank for a carton of the present invention.

Turning next the drawings, it can be noted that FIGS. 1A to 1P illustrate how a carton in accordance with at least some embodiments is converted from a storage position to a serving position. A "storage position" means a configuration in which flaps in the lower end portion are folded to close the lower end portion. A "serving position" means a configuration where these flaps have been refolded to an open position, in which the flaps extend outwards so that the carton becomes raised and supported to a desired height. Preferably, the height corresponds to a height of a receptacle, such as a glass.

FIG. 1A shows a bag in box liquid packaging. The carton 11 of the packaging contains four sidewalls (two of which are shown in FIG. 1A: 14*a*, 14*b*) and is shown in a storage position. The carton contains two circular openings 12*a*, 12*b* in upper flaps, which flaps close the upper end portion of the carton. The openings 12*a*, 12*b* function as a handle for carrying the packaging. Additionally there is a circular perforated area in the sidewall 14*b*, which area can be pushed in to form an opening 13*a* for the tap 59.

To begin assembling the stand, the user first turns the carton upside down, as shown in FIG. 1B. The user tears off an elongated rectangular area 31 in order to separate from each other the two topmost flaps 51, 52 closing the lower end portion of the carton, see FIGS. 1C-1E.

The first pair of opposing flaps 53 and 54 as well as the second pair of opposing flaps 51 and 52 are unfolded and the lower end part of the carton becomes opened, see FIGS. 1F-1G. In FIG. 1H, the flap 52 is folded back to a closed position so that it forms a base towards which the liquid bag is able to rest inside the carton. Another important function of the flap 52 is to provide a supporting surface for the flap 51 in its perpendicular position, which is described in the following.

The flap 51 is has a length greater than the distance between the opposing sidewalls 14*a* and 14*c*. The flap 51 is foldable into an essentially perpendicular position, shown in FIG. 1I, with regard to a plane parallel to the lower end portion of the carton. This is enabled by a folding line 55 extending across the flap 51 at a distance of roughly half of the width of the lower end portion in the direction of the flap 51.

The front end of the flap 51 exhibits protruding tongues 56*a*, 56*b*, one on each side of the flap 51. The general shape of the tongues 56*a* and 56*b* is rectangular. Also the general shape of the central part 56*c* of the front end remaining between the tongues 56*a* and 56*b* is rectangular. In this embodiment, said central part 56*c* protrudes further than the tongues 56*a* and 56*b* adjacent to it. In other embodiments, the central part and the tongues can have other dimensions, for example similar lengths with regard to each other in the direction of the flap 51, whereby the front end becomes substantially even and aligned.

The flaps 53 and 54 have longitudinal slits 57*a* (not shown) and 57*b*, respectively. The slits 57*a*, 57*b* and the tongues 56*a*, 56*b* match each other in a manner that each of the tongues can be introduced into the corresponding slit, see FIGS. 1J-1L. In FIG. 1L the flaps 53 and 54 are interlocked so that a pair of legs is formed with the flap 51 fixed between the legs. In FIGS. 1M-1P, the legs are fixed in all directions. Particularly, any significant movement of the legs in the direction of the flap 51 is prevented.

In one embodiment, the material of one or more of the flaps 51, 52, 53, 54 is stiffer than the material of the rest of the carton in order to make the stand more rigid. In a preferred embodiment, the front ends of the flaps 53 and 54 have been reinforced by attaching an extra carton layer, such as the areas 72 in FIG. 2, onto said front ends. A similar reinforcement can be produced by folding the end portions of the flaps such that they overlap with the adjacent part of the flap, and optionally adhering the overlapping portion against the corresponding flap.

Once the flaps 51, 52, 53, 54 have been refolded as shown in FIGS. 1D-1L, the stand is ready and the user turns the carton back to its original position, with the handle openings 12*a*, 12*b* facing up, see FIG. 1M. In this configuration, both flaps 51 and 52 contribute to support the bag.

Above the opening 13*a*, there is a foldable part 13*b*, which can be temporarily folded up (see FIG. 1O) if more space or visibility is needed when pulling out the tap 59.

In FIGS. 1M-1P the carton 11 is in the serving position with the carton 11 and particularly the tap 59 in an elevated position, which enables the user to place a glass 60 right under the pulled-out tap 59 and at the same time partially between the legs formed by the interlocked flaps 53 and 54, see FIG. 1P.

Figure 2:
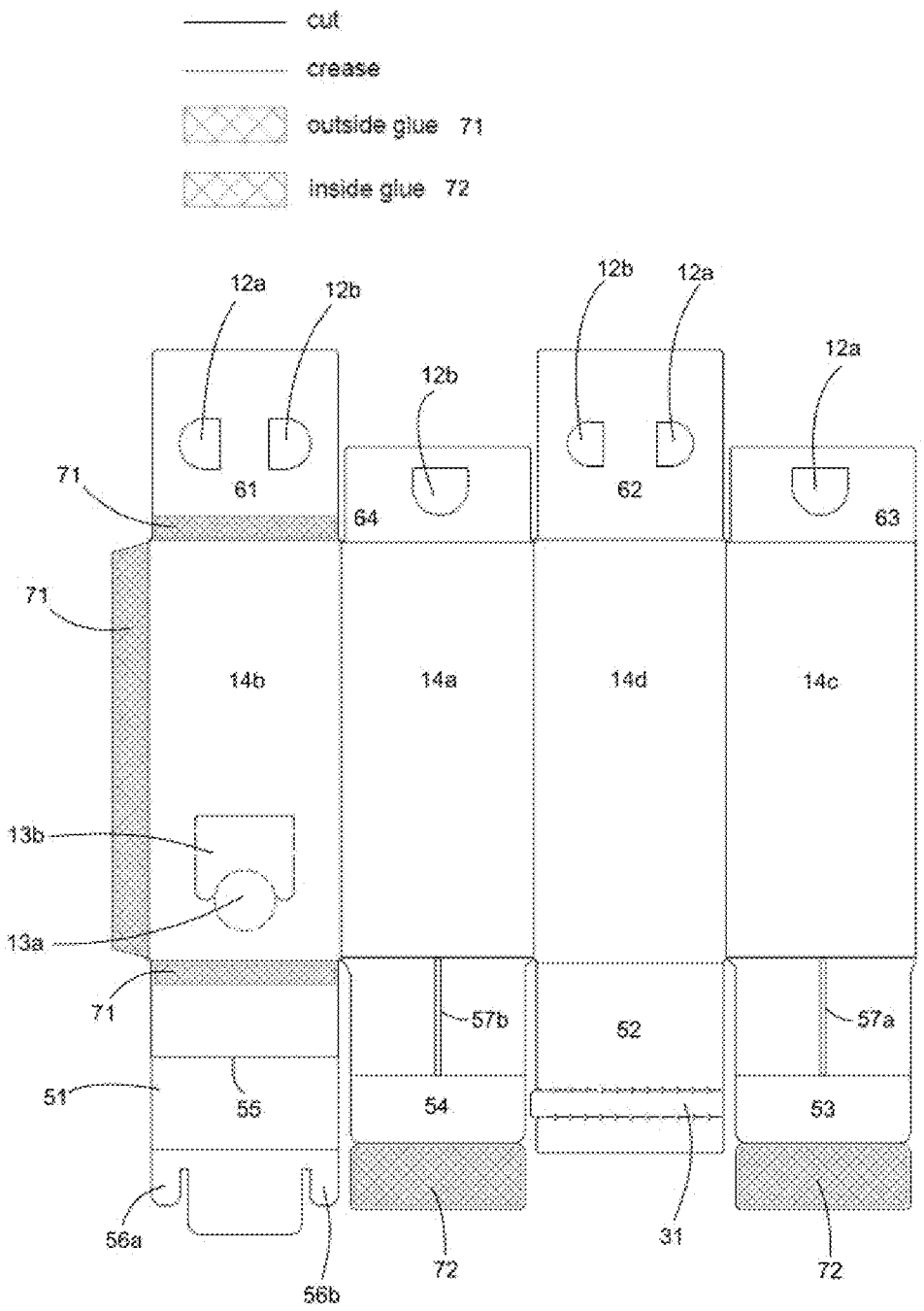
FIG. 2 illustrates a blank in accordance with at least some embodiments of the present invention.

FIG. 2 shows a blank for a carton of FIGS. 1A-1P. Upon forming a carton, the areas marked with the reference sign 71 will be glued on the outside of the blank, while the areas marked with the reference sign 72 will be glued on the inside of the blank. The areas 72 are to be folded and glued against the front ends of the corresponding flaps 53 and 54.

The reference signs in FIG. 2 correspond to those used in FIGS. 1A-1P.

FIG. 2 illustrates in detail how the handle openings 12*a* and 12*b* extend through each of the upper flaps 61, 62, 63, and 64.

According to one embodiment said first pair of flaps 53, 54 is formed by opposing flaps which are inner flaps when the lower end portion is closed by the flaps.

According to one embodiment the second pair of flaps 51, 52 is formed by opposing flaps which are outer flaps when the lower end portion is closed by the flaps.

According to one embodiment the first flap 51 of said second pair of opposing flaps is foldable into an essentially perpendicular position with regard to a plane parallel to the lower end portion for interlocking said leg-forming flaps.

According to one embodiment the first flap 51 of said second pair of opposing flaps is foldable into said perpendicular position along a folding line 55 extending across the flap 51 at a distance of roughly half of the width of the opening in the direction of the flap.

According to one embodiment the second flap 52 of said second pair of opposing flaps is foldable into a closed position when the first pair of flaps is folded into the open position, such as to form a bag holding base inside the cavity.

According to one embodiment the second flap 52 of said second pair of opposing flaps is foldable into a closed position such as to form a support surface for the first flap 51 of said second pair of opposing flaps when it interlocks the first pair when folded into open position.

According to one embodiment the second flap 52 of said second pair of opposing flaps has a length greater than half the distance between any of two opposing sidewalls. The second flap will, when folded into a closed position, form the bottom of the carton and supported by the first flap of the second pair of flaps, be capable of supporting the bag inside the carton when the carton is placed in the elevated position.

In an embodiment, the second flap 52 is configured such that it will be able to prevent the first flap 51, and particularly the tongues in it, from withdrawing from the slits.

According to one embodiment the first pair of opposing flaps has longitudinal slits, and the front end of the first flap of the second pair of flaps exhibits protruding tongues, one on each side of the flap facing the flap and matching the slits, whereby the leg-forming flaps can be interlocked by introducing each tongue into the corresponding slit.

According to one embodiment the carton consists of corrugated cardboard. The advantage of this embodiment is that corrugated cardboard is a very stiff material and thus suitable for providing rigidity to the legs of the carton.

In one embodiment, the upper end is shaped into a handle to facilitate handling of the carton.

According to an embodiment, the carton contains two openings in upper flaps that close the upper end portion. Said openings provide a means for carrying the carton by inserting fingers to the openings. Said openings extend through all upper flaps.

According to an embodiment, a blank for a carton comprises:

four hingedly connected side panels (14*a*, 14*b*, 14*c*, 14*d*) arranged to be suitable for forming a substantially tubular structure, a first pair (53, 54) and a second pair (51, 52) of bottom panels hingedly connected to lower edges of the side panels, wherein the panels of each pair are arranged to be opposing each other in the carton, two pairs of top panels hingedly connected to upper edges of the side panels and suitable for closing an upper end portion of the carton, an opening (13*a*) extending through one side panel near its lower edge, wherein said first pair of bottom panels are suitable for being folded into a closed position, in which the panels together with the second pair of bottom panels close a lower end portion of the carton, and an open position, in which the panels extend outwards from the tubular structure to form a pair of legs, while a first panel (51) of said second pair of bottom panels is foldable into an open position where it is capable of interlocking said first pair of bottom panels when they are folded into said open position, in order to fix the position of the legs with regard to the carton, whereby said leg-forming panels are capable of supporting the carton on a surface so as to provide an elevated position for the opening (13*a*) with respect to the surface.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to one embodiment or an embodiment means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment. Where reference is made to a numerical value using a term such as, for example, about or substantially, the exact numerical value is also disclosed.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the following description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The verbs "to comprise" and "to include" are used in this document as open limitations that neither exclude nor require the existence of also un-recited features. The features recited in depending claims are mutually freely combinable unless otherwise explicitly stated. Furthermore, it is to be understood that the use of "a" or "an", that is, a singular form, throughout this document does not exclude a plurality.

INDUSTRIAL APPLICABILITY

At least some embodiments of the present invention find industrial application in the manufacturing of bag in box liquid packagings. The bag-in-box packaging can be used for containing beverages, such as wine, fruit juices, milk, water and similar liquids. The bag can be capable of containing typically from 0.5 liter up to 6 liters, for example 0.75 to 4 liters, such as 1.0 to 3 liters. The carton can also be used for holding and optionally dispensing solid materials, preferably flowable materials, such as beads, granules, powders, and flour, said materials filled into the cavity directly or placed into a bag inside the cavity.

REFERENCE SIGNS LIST

11 a carton of a bag in box packaging
12*a*, 12*b* handle openings
13*a* an opening
13*b* a foldable part
14*a*, 14*b*, 14*c*, 14*d* sidewalls
31 a rectangular area
51 the first flap of the second pair of opposing flaps
52 the second flap of the second pair of opposing flaps
53 the first flap of the first pair of opposing flaps
54 the second flap of the first pair of opposing flaps
55 a folding line
56*a*, 56*b* tongues
56*c* a central part
57*a*, 57*b* slits
59 a tap
60 a glass
61, 62, 63, 64 upper flaps
71 outside glue areas
72 inside glue areas

CITATION LIST

Patent Literature

US 2011095037 (A1)
EP 1826130 (B1)
FR 2798912 (A1)
NL 8900666 (A)

The invention claimed is:

1. A carton for a bag in box packaging, said carton comprising:

having the overall configuration of a rectangular parallelepiped, with two pairs of opposing sidewalls and an upper end portion and a lower end portion, together defining a cavity for receiving a liquid holding bag, the lower end portion comprising:

a first pair of opposing flaps and a second pair of opposing flaps;

said carton also having an opening extending through one sidewall in the vicinity of the lower end portion, through which opening liquid can be dispensed from the liquid holding bag positioned inside the cavity, wherein said first pair of opposing flaps are foldable into:

a closed position, in which the flaps together with the second pair of opposing flaps close the lower end portion, and an open position, in which the flaps extend outwards from the cavity to form a pair of legs, wherein a first flap of said second pair of opposing flaps is foldable into an open position where it is capable of interlocking said first pair of opposing flaps when they are folded into said open position, in order to fix the position of the legs with regard to the carton, and whereby said leg-forming flaps are capable of supporting the carton on a surface so as to provide an elevated position for the opening with respect to the surface.

2. The carton according to claim 1, wherein said first pair of flaps is formed by opposing flaps which are inner flaps when the lower end portion is closed by the flaps, and wherein the second pair of flaps is formed by opposing flaps which are outer flaps when the lower end portion is closed by the flaps.

3. The carton according to claim 1, wherein the first flap of said second pair of opposing flaps is foldable into an essentially perpendicular position with regard to a plane parallel to the lower end portion for interlocking said leg-forming flaps, and wherein the first flap of said second pair of opposing flaps is foldable into said perpendicular position along a folding line extending across the flap at a distance of roughly half of the width of the cavity in the direction of the flap.

4. The carton according to claim 3, wherein the second flap of said second pair of opposing flaps is foldable into a closed position when the first pair of flaps is folded into the open position, such as to form a bag holding base inside the cavity.

5. The carton according to claim 4, wherein the first pair of opposing flaps has longitudinal slits, and the front end of the first flap of the second pair of flaps exhibits protruding tongues, one on each side of the flap facing the flap and matching the slits, whereby the leg-forming flaps can be interlocked by introducing each tongue into the corresponding slit.

6. The carton according to claim 3, wherein the second flap of said second pair of opposing flaps is foldable into a closed position such as to form a support surface for the first flap of said second pair of opposing flaps when it interlocks the first pair when folded into open position.

7. The carton according to claim 6, wherein the second flap of said second pair of opposing flaps has a length greater than half the distance between any of two opposing sidewalls.

8. The carton according to claim 7, wherein the first pair of opposing flaps has longitudinal slits, and the front end of the first flap of the second pair of flaps exhibits protruding tongues, one on each side of the flap facing the flap and matching the slits, whereby the leg-forming flaps can be interlocked by introducing each tongue into the corresponding slit.

9. The carton according to claim 6, wherein the first pair of opposing flaps has longitudinal slits, and the front end of the first flap of the second pair of flaps exhibits protruding tongues, one on each side of the flap facing the flap and matching the slits, whereby the leg-forming flaps can be interlocked by introducing each tongue into the corresponding slit.

10. The carton according to claim 3, wherein the second flap of said second pair of opposing flaps has a length greater than half the distance between any of two opposing sidewalls.

11. The carton according to claim 10, wherein the first pair of opposing flaps has longitudinal slits, and the front end of the first flap of the second pair of flaps exhibits protruding tongues, one on each side of the flap facing the flap and matching the slits, whereby the leg-forming flaps can be interlocked by introducing each tongue into the corresponding slit.

12. The carton according to claim 3, wherein the first pair of opposing flaps has longitudinal slits, and the front end of the first flap of the second pair of flaps exhibits protruding tongues, one on each side of the flap facing the flap and matching the slits, whereby the leg-forming flaps can be interlocked by introducing each tongue into the corresponding slit.

13. The carton according to claim 1, wherein the first pair of opposing flaps has longitudinal slits, and the front end of the first flap of the second pair of flaps exhibits protruding tongues, one on each side of the flap facing the flap and matching the slits, whereby the leg-forming flaps can be interlocked by introducing each tongue into the corresponding slit.

14. The carton according to claim 1, consisting of corrugated cardboard.

15. The carton according to claim 1, wherein the upper end portion is shaped into a handle to facilitate handling of the carton.

16. A blank for forming a carton, said carton comprising:

having the overall configuration of a rectangular parallelepiped, with two pairs of opposing sidewalls and an upper end portion and a lower end portion, together defining a cavity for receiving a liquid holding bag, the lower end portion comprising:

a first pair of opposing flaps and a second pair of opposing flaps;

having an opening extending through one sidewall in the vicinity of the lower end portion, through which opening liquid can be dispensed from the liquid holding bag positioned inside the cavity, wherein said first pair of opposing flaps are foldable into:

a closed position, in which the flaps together with the second pair of opposing flaps close the lower end portion, and an open position, in which the flaps extend outwards from the cavity to form a pair of legs, wherein a first flap of said second pair of opposing flaps is foldable into an open position where it is capable of interlocking said first pair of opposing flaps when they are folded into said open position, in order to fix the position of the legs with regard to the carton, and whereby said leg-forming flaps are capable of supporting the carton on a surface so as to provide an elevated position for the opening with respect to the surface.

17. The blank according to claim 16, having a structure according to FIG. 2 of the accompanying drawings.

18. The blank according to claim 16, further comprising:

four hingedly connected side panels arranged to be suitable for forming a substantially tubular structure, a first pair and a second pair of bottom panels hingedly connected to lower edges of the side panels, wherein the panels of each pair are arranged to be opposing each other in the carton, two pairs of top panels hingedly connected to upper edges of the side panels and suitable for closing an upper end portion of the carton, and an opening extending through one side panel near its lower edge, wherein said first pair of bottom panels are suitable for being folded into:

a closed position, in which the panels together with the second pair of bottom panels close a lower end portion of the carton, and an open position, in which the panels extend outwards from the tubular structure to form a pair of legs, wherein a first panel of said second pair of bottom panels is foldable into an open position where it is capable of interlocking said first pair of bottom panels when they are folded into said open position, in order to fix the position of the legs with regard to the carton, whereby said leg-forming panels are capable of supporting the carton on a surface so as to provide an elevated position for the opening with respect to the surface.

19. A bag in box packaging, comprising a carton, said carton comprising:

having the overall configuration of a rectangular parallelepiped, with two pairs of opposing sidewalk and an upper end portion and a lower end portion, together defining a cavity for receiving a liquid holding bag, the lower end portion comprising:

a first pair of opposing flaps and a second pair of opposing flaps;

having an opening extending through one sidewall in the vicinity of the lower end portion, through which opening liquid can be dispensed from the liquid holding bag positioned inside the cavity, wherein said first pair of opposing flaps are foldable into:

a closed position, in which the flaps together with the second pair of opposing flaps close the lower end portion, and an open position, in which the flaps extend outwards from the cavity to form a pair of legs, wherein a first flap of said second pair of opposing flaps is foldable into an open position where it is capable of interlocking said first pair of opposing flaps when they are folded into said open position, in order to fix the position of the legs with regard to the carton, and whereby said leg-forming flaps are capable of supporting the carton on a surface so as to provide an elevated position for the opening with respect to the surface, wherein said cavity of the carton encloses a liquid holding bag equipped with a tap arranged to extend through said opening extending through one sidewall in the vicinity of the lower end portion.

20. The bag in box packaging according to claim 19, further comprising a carton wherein the first pair of opposing flaps has longitudinal slits, and the front end of the first flap of the second pair of flaps exhibits protruding tongues, one on each side of the flap facing the flap and matching the slits, whereby the leg-forming flaps can be interlocked by introducing each tongue into the corresponding slit.

* * * * *